US006471369B1

(12) United States Patent
Valella, Jr.

(10) Patent No.: US 6,471,369 B1
(45) Date of Patent: Oct. 29, 2002

(54) LIGHTING SYSTEM OBSERVABLE BY HUMANS BUT NOT TURTLES TO PROTECT TURTLE NESTING ENVIRONMENT

(75) Inventor: John Valella, Jr., Ft. Lauderdale, FL (US)

(73) Assignee: Lighting the Way Enterprises, Inc., Miami, FL (US)

( * ) Notice: Subject to any disclaimer, the term of this patent is extended or adjusted under 35 U.S.C. 154(b) by 0 days.

(21) Appl. No.: 09/865,614

(22) Filed: May 25, 2001

(51) Int. Cl.[7] ..... F21V 9/08
(52) U.S. Cl. ..... 362/230; 362/265; 362/293
(58) Field of Search ..... 362/221, 216, 362/263, 230, 231, 293; 313/112, 484, 572, 577; 250/495.1

(56) References Cited

U.S. PATENT DOCUMENTS

| | | | | | |
|---|---|---|---|---|---|
| 4,498,125 | A | * | 2/1985 | Schumaker | 362/216 |
| 4,500,810 | A | * | 2/1985 | Graff | 313/486 |
| 4,988,914 | A | * | 1/1991 | Rutfield et al. | 313/112 |
| 5,184,562 | A | * | 2/1993 | Hallin | 114/219 |
| 5,436,813 | A | | 7/1995 | Gonzalez | 362/216 |
| 5,483,124 | A | | 1/1996 | Kaviani | 315/86 |
| 6,095,074 | A | | 8/1996 | Reinhardt | 114/219 |
| 5,564,818 | A | | 10/1996 | Grossman et al. | 362/221 |
| 6,060,830 | A | * | 5/2000 | Sugitani et al. | 313/571 |

OTHER PUBLICATIONS

Florida Power & Light, Reducing The Impact of Artificial Light on Sea Turtles, Monday Feb. 26, 2001.

Kenneth J. Lohmann & Catherine M. F. Lohmann Orientation and Open–Sea Navigation in Sea Turtles, 1996, The Journal of Experimental Biology.

Pompano Beach, Florida, Ordinance 99–14 passed Dec. 8, 1998, as ameded Ord. 2000–34 passed Jan. 25, 2000 and Ord. 2000–64 passed Jun. 13, 2000, codified at Florida Code of Ordinances §155.139 Lighting Requirements for Marine Turtle Protection.

Website of Florida Fish and Wildlife Conservation Commission, "Sea Turtle Protection Ordinances Adopted by Counties and Municipalities (as of May 2001)", 5 pages , circa 2001.

* cited by examiner

*Primary Examiner*—Sandra O'Shea
*Assistant Examiner*—Hargobind S. Sawhney
(74) *Attorney, Agent, or Firm*—Westman, Champlin & Kelly, P.A.

(57) ABSTRACT

An outdoor light fixture for use with a specifically selected gas discharge lamp which emits a predetermined light of wavelengths that are least visible to sea turtles but visible to humans which adequately illuminates outdoor human living spaces for safety without harming sea turtle nesting activity. The light fixture includes an illumination tube having a specifically selected gas discharge tube, power supply circuitry having a first and second transformer and bridge rectifier for low and high voltage control, and a lamp housing.

5 Claims, 4 Drawing Sheets

LIGHTING SYSTEM OBSERVABLE BY HUMANS BUT NOT TURTLES TO PROTECT TURTLE NESTING ENVIRONMENT

BACKGROUND OF THE INVENTION

1. Field of the Invention

This invention relates generally to outdoor lighting fixtures for illuminating outdoor human living space, walkways, docks and ocean area walls and more specifically, to gas discharge lamps used within lighting fixtures to illuminate outdoor human living and work areas in close proximity to ocean turtle habitats to protect sea turtles.

2. Description of Related Art

Lighting fixtures for illuminating outdoor living spaces for humans such as condominium walkways or docks are well known. Although such outdoor lighting techniques are well known, illuminating areas in close proximity to ocean beaches has not been satisfactory. Each year ocean beaches all over the world serve as important nesting habitat for several species of threatened and endangered sea turtles. Sea turtle nesting season begins in late spring and concludes in late summer. During the process of nesting an adult female sea turtle emerges from the ocean onto the beach and prepares a nest site by pushing or digging surface sand away to form a body pit and egg cavity pit where she deposits the eggs within the egg cavity pit. The female sea turtle camouflages the nest by covering it with sand and then re-enters the ocean. Incandescent and fluorescent artificial light on or near nesting beaches can negatively affect the nesting process. Sea turtles almost always nest at night. Lights used to illuminate areas near nesting beaches can deter sea turtles from emerging out of the ocean to nest and may cause sea turtles to abandon nesting attempts. After the nesting process, eggs are left to hatch on the beach. Sea turtle hatchlings nearly always emerge from their nests at night. Once on the beach, sea turtle hatchlings must reach the ocean quickly to avoid being preyed upon by predators. To orient themselves, sea turtle hatchlings use light as a guide. Because water reflects more moonlight and starlight than does land, the oceanic horizon at night is brighter than the landward horizon. Light fixtures used to illuminate areas in close proximity to beaches distract and disorient sea turtle hatchlings when trying to locate the ocean causing them to crawl in the wrong direction and eventually die due to exposure to predators or dehydration. The negative effects of lighting near ocean beaches on sea turtles has prompted cities such as Pompano Beach, Fla., to create ordinances which limit or restrict lighting near ocean beaches. These ordinances may require that light fixtures be turned off in some circumstances.

At the same time, the elimination of lighting in areas near ocean beaches due to such ordinances can cause hazards to humans. Unlighted walkways or corridors within beach condominiums, apartments, homes, docks or other beach fronting properties that are commonly frequented by people can become hazardous and create injury. In addition, insurance companies require security and safety outdoor lighting, especially on walkways.

Common incandescent and fluorescent light fixtures used to illuminate areas in close proximity to ocean beaches are not satisfactory because of their inability to contain or direct the light emitted to the area specified. Such conventional fixtures do not reduce or limit the illumination of the nearby horizon or prevent visibility of the actual luminary contained within the fixture from the nearby horizon. These common light fixtures allow white and fluorescent light to escape undirected, allowing the lighting to spread, creating a confusing and disorienting lighting effect on baby sea turtles emerging from a nest as well as deterring adult sea turtles from emerging from the ocean to nest.

Common light fixtures typically use incandescent lamps. Incandescent lamps are inefficient in creating light commonly using three to four times the energy required by fluorescent lamps or discharge tubes of an equivalent light output. Some improved light fixtures may use fluorescent lamps for their increased efficiency. Fluorescent lamps require relatively large ballast devices and sometimes starter devices. This can inhibit their use in certain applications. Other light fixtures may use discharge tubes to avoid the requirement of having a bulky ballast and starter.

The white light produced by lamps used within common light fixtures is distracting and disorienting to baby sea turtles in their attempt to find the ocean and deters adult sea turtles from emerging from the ocean to nest.

Published biological studies and technical reports show that light of wavelengths longer than 680 nm are least visible and minimally distracting to sea turtles.

The present invention provides a light fixture that directs and controls the light distribution pattern emitted from the light source observable by humans in a pattern and direction that are least distracting and disorienting to baby sea turtles emerging from their nest searching for the ocean, as well as does not deter adult sea turtles from emerging from the ocean to nest. The present invention provides an illumination tube and fixture that emits a light of predetermined, specific longer wavelengths that are least visible to both baby and adult sea turtles, thereby reducing any impact on the normal activities of both baby and adult sea turtles, yet still within the human visible spectrum and effective in illuminating outdoor living areas. Also the present invention is easily mounted on typical beach structures such as dock pilings or building structures near outdoor living areas such as walkways and stairs and is energized by a safe low voltage light power source.

BRIEF SUMMARY OF THE INVENTION

A light source and fixture for use outdoors, in close proximity to ocean beaches which directs and controls the wavelength and light pattern area in human living surroundings that utilizes an illumination tube light source which emits light of wavelengths which are unobservable to sea turtles but observable to human beings, the light fixture is easily affixed to typical beach structures and does not require high voltage for its operation.

The light source and fixture includes an illumination tube, power supply circuitry and a lamp housing or enclosure that distributes the light rays in a specific area and pattern.

The illumination tube includes a gas discharge tube which is contained within a protective transparent tube cover. The tube cover uses connector brackets to attach to the lamp housing. The gas discharge tube is adapted to emit light of a wavelength of 680–780 nm when energized. These wavelengths are within the human visible spectrum and are least visible to sea turtles and are least likely to disorient newly hatched sea turtles searching for the ocean or deter adult sea turtles from emerging from the ocean to nest and are effective in illuminating walkways and corridors.

The power supply circuitry includes a first and second transformer and a rectifier that are electrically connected and supplied by conventional AC. Available 110 volt AC household current is converted by the first transformer to 12 volt AC current, and then converted to 12 VDC current by the rectifier which is carried by suitable wiring to the second high voltage transformer contained in the lamp housing which converts the 12 VDC current to high voltage current (approx. 7000–9000V) sufficient to energize the gas discharge tube.

The lamp housing encloses the illumination tube and the second high voltage transformer and is constructed from an opaque material adapted to allow the passage of light emitted from the illumination tube to the selected area by limiting the angles in which the light may escape from the housing. The lamp housing has opaque walls with a predetermined specific aperture that emits light rays in a pattern depending on the light source shape and position relative to the aperture. The walls are designed so that illumination of undesired areas due to direct or indirect lighting can be controlled and minimized by allowing light to escape in a specific pattern and direction only. Further, the lamp housing does not allow the illumination tube to be viewed directly from nearly all angles limiting visibility of the illumination tube from the nearby ocean horizon or beach and any influence on sea turtles. Several light fixtures may be wired in parallel so that a larger area can be illuminated.

In one embodiment of the invention the illumination tube is circular and the lamp housing is cylindrical in shape. The lamp housing is constructed of a cylindrical or conical shade, a hollow rigid vertical support that receives electrical wiring and a rigid support base. The shade is closed at the top end and open at the bottom end and constructed of an opaque material such as fiberglass.

The illumination tube is formed in the shape of a circle whose diameter is slightly smaller than the opaque shade and is enclosed within the shade and attached to the top of the shade from within. The hollow rigid vertical support supports the shade at one end and is attached to the inside top of the shade so that it is partially enclosed by the shade and centered within. The hollow vertical support is attached at the lower end to the center of the support base.

The vertical support contains the second transformer which converts the 12 volt DC current supplied by the first voltage transformer and rectifier to high voltage current sufficient to energize the illumination tube and is electrically connected to the discharge tube. The lamp housing can be mounted on dock pilings, railings or other common ocean side fixtures by securing the base to such fixtures. The support base can be fixed to a post or dock rail by incorporating holes for screw or bolt fasteners.

The second transformer is electrically connected to the illumination tube so that when 12 volt DC electrical current is sent from the first transformer and rectifier, the discharge tube is energized. Once energized, the illuminating light rays emitted from the discharge tube are contained and directed in a pattern by the shade through the bottom open end of the shade, providing light in a downward direction which illuminates only the immediate intended area. The downward light pattern created by the lamp enclosure shade reduces indirect lighting of the nearby beach and horizon minimizing any influence on newly hatched sea turtles searching for the ocean or adult sea turtles emerging from the ocean. The lamp housing can be mounted on dock pilings, railings or other common ocean side fixtures by securing the base to such fixtures.

In another embodiment of the invention the illumination tube is linear and elongated and the lamp housing is rectangular and elongated. The illumination tube is a linear and elongated discharge tube sealed within a tube cover at both ends by end caps. The end caps receive the tube cover and the discharge tube, so that the discharge tube is held within the center of the tube cover. The tube cover is cylindrical and constructed from a transparent material so that light may pass outwardly from the discharge tube. The second transformer is enclosed and housed within one end cap and is electrically connected to the discharge tube. The illumination tube is mounted in a hollow rigid elongated rectangular shaped enclosure which is open at both ends and constructed of an opaque material such as aluminum. Each open end of the enclosure is closed and sealed by the attachment of an opaque end plug. One end plug is adapted to allow wiring to pass through to supply electric current from the first voltage transformer and bridge rectifier to the second voltage transformer. The enclosure has an elongated aperture so that light emitted from the discharge lamp within can pass through the aperture and illuminate the intended area. The enclosure provides a light pattern that reduces direct and indirect lighting of the nearby beach and horizon minimizing any influence on newly hatched sea turtles searching for the ocean or adult sea turtles emerging from the ocean. The enclosure can be attached to walls, stairs or other flat surfaces by screw or bolt fasteners. The enclosure has wire apertures for electrical wires so that power can be supplied to the tube.

It is an object of this invention to provide a light source that emits light of longer wavelengths that are minimally visible to sea turtles and visible to humans.

It is another object of the invention to provide a light fixture that controls and directs light emitted by the light source contained within to limited areas observable by humans intended further minimizing visibility to sea turtles.

It is a further object of this invention to provide a light source and light fixture that emits light of predetermined frequencies which can effectively illuminate specific areas frequented by people while eliminating hazardous illumination to turtles.

In accordance with these and other objects which will become apparent hereinafter, the instant invention will now be described with particular reference to the accompanying drawings.

DETAILED DESCRIPTION OF THE INVENTION

Figure 1:
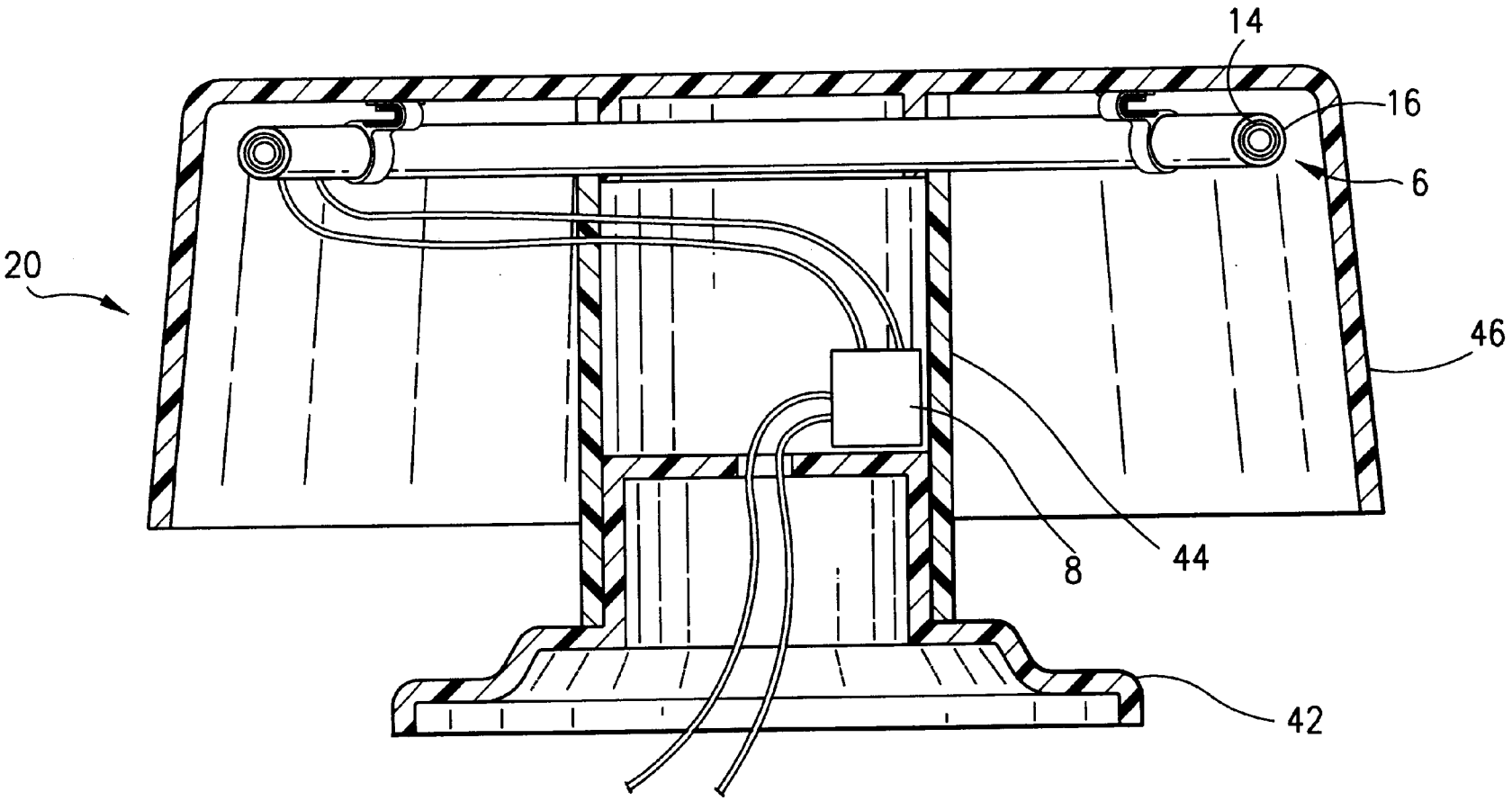
FIG. 1 is a side elevational view in cross section of one embodiment of the invention.

Referring now to the drawings, and more particularly FIG. 1, there is shown one embodiment of the device. The illumination tube 6 and lamp housing 20 together comprise the invention. The illumination tube 6 is connected to second transformer 8. A circular discharge tube 14 contained by a circular transparent tube cover 16 form illumination tube 6. The illumination tube 6 emits light in a range of wavelengths of 680–780 nm when energized by utilizing neon gas within the discharge tube 14.

Figure 3:
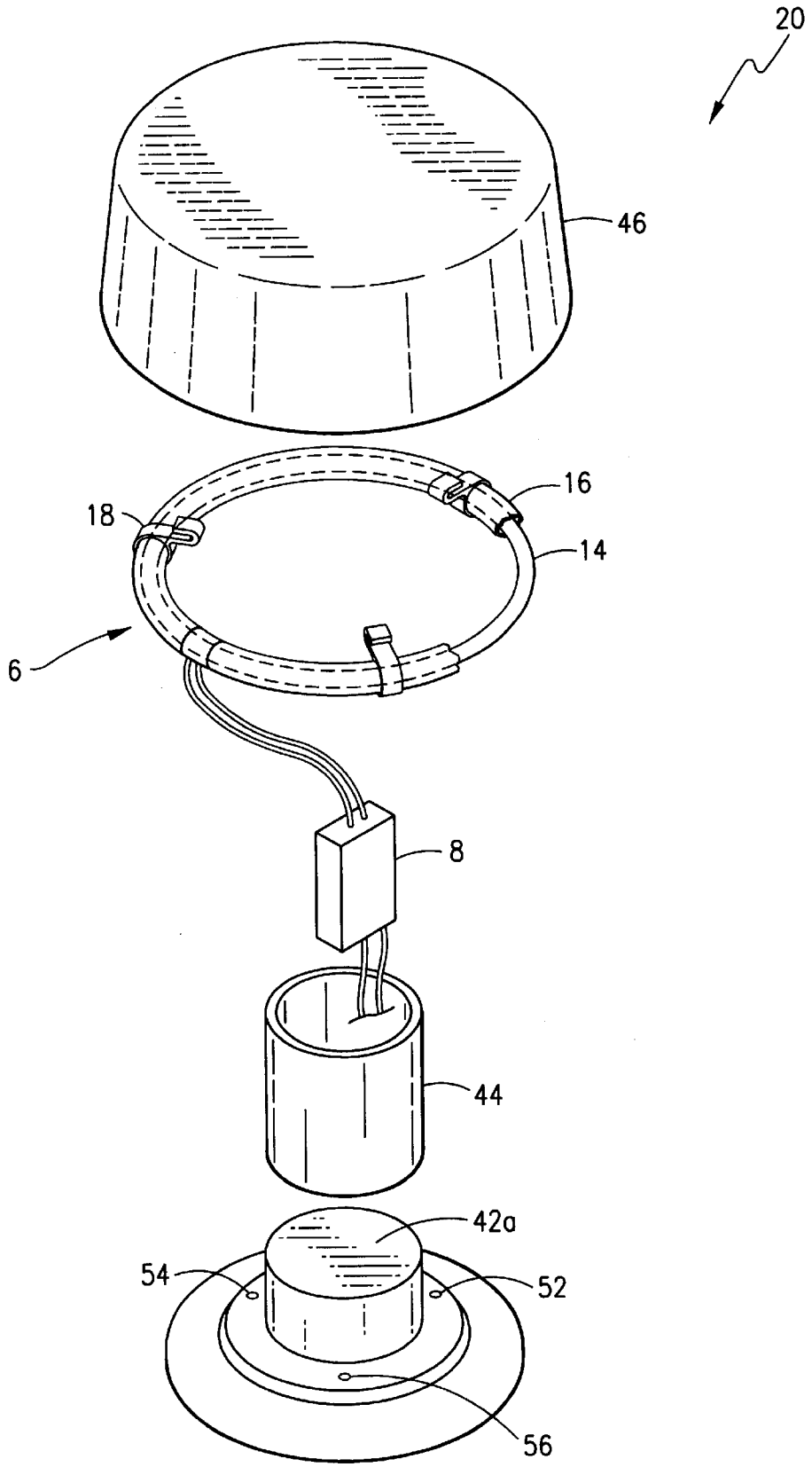
FIG. 3 is a perspective exploded view of the embodiment depicted in FIG. 1.
Figure 4:
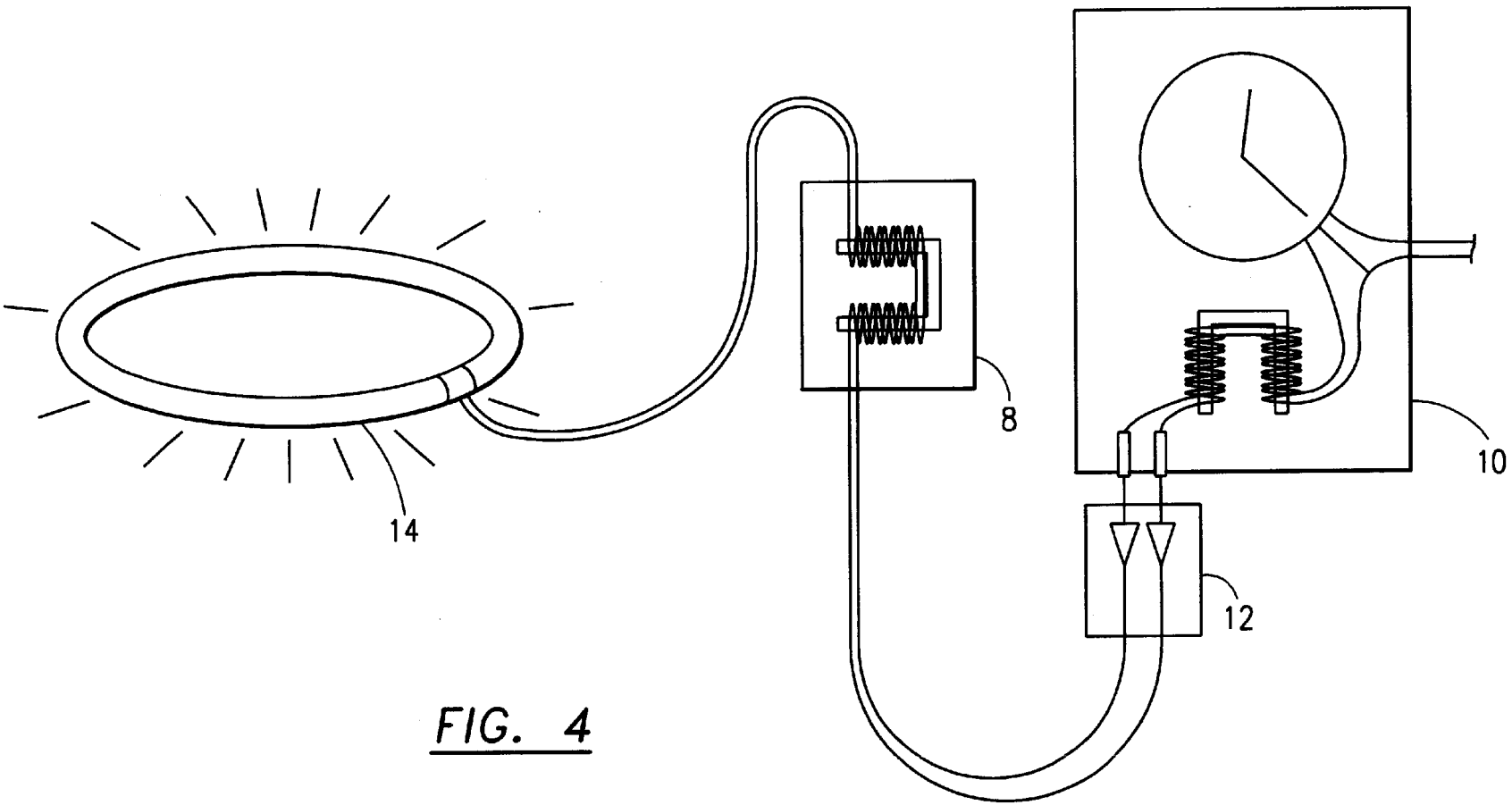
FIG. 4 is a schematic representation of the power supply circuitry of the invention.

Referring now to FIG. 4, there is illustrated the power supply circuitry of the invention. The power supply circuitry includes a first transformer 10, bridge rectifier 12 and second transformer 8. The first transformer 10 is connected to a bridge rectifier 12. 110 volt AC is converted to 12 volt DC by passing through the first transformer 10 and bridge rectifier 12 which is connected to the second transformer 8 by suitable wiring. Second transformer 8 includes a step up transformer sealed within a protective case as seen in FIG. 3. Second transformer 8 is mounted within the lamp housing and receives 12 volt DC current from the first transformer/rectifier and converts it to 7000–9000 volt DC current sufficient to energize discharge tube 14. Discharge tube 14 is connected by wires to second transformer 8.

Referring now to FIG. 3, the lamp housing 20 is formed by a disk shaped rigid support base 42 for self standing or attachment to a solid support, hollow rigid vertical support 44 and cylindrical shade 46. Base 42 is attached to vertical support 44 by having a short vertical cylindrical wall which fits tightly within the inside wall of vertical support 44 and is affixed using an adhesive or screw fasteners. The top wall 42*a* of base 42 allows wiring to pass through to second transformer 8 which is enclosed by and affixed within vertical support 44 using fastening means such as adhesive or screw fasteners. Base 42 is tapered so that the bottom is larger in diameter than the diameter of top wall 42*a* and can be attached to a dock piling or cement block with screw or bolt fasteners through holes 52, 54 and 56. Cylindrical shade 46 is closed at the top. Illumination tube 6 is shaped in a circle and smaller in overall diameter than shade 46. Illumination tube 6 is enclosed by shade 46 and is attached to the inside top of shade 46 by brackets 18 affixed to the inside top of shade 46 by adhesive. The inside top of shade 46 is attached to vertical support 44 by having a short centered vertical cylindrical wall which fits tightly within the inside wall of vertical support 44 so that the short vertical cylindrical wall is contained within vertical support 44 and affixed using adhesive. Vertical support 44 has a passage which allows wiring from the second transformer 8 through to the illumination tube 6.

Figure 2:
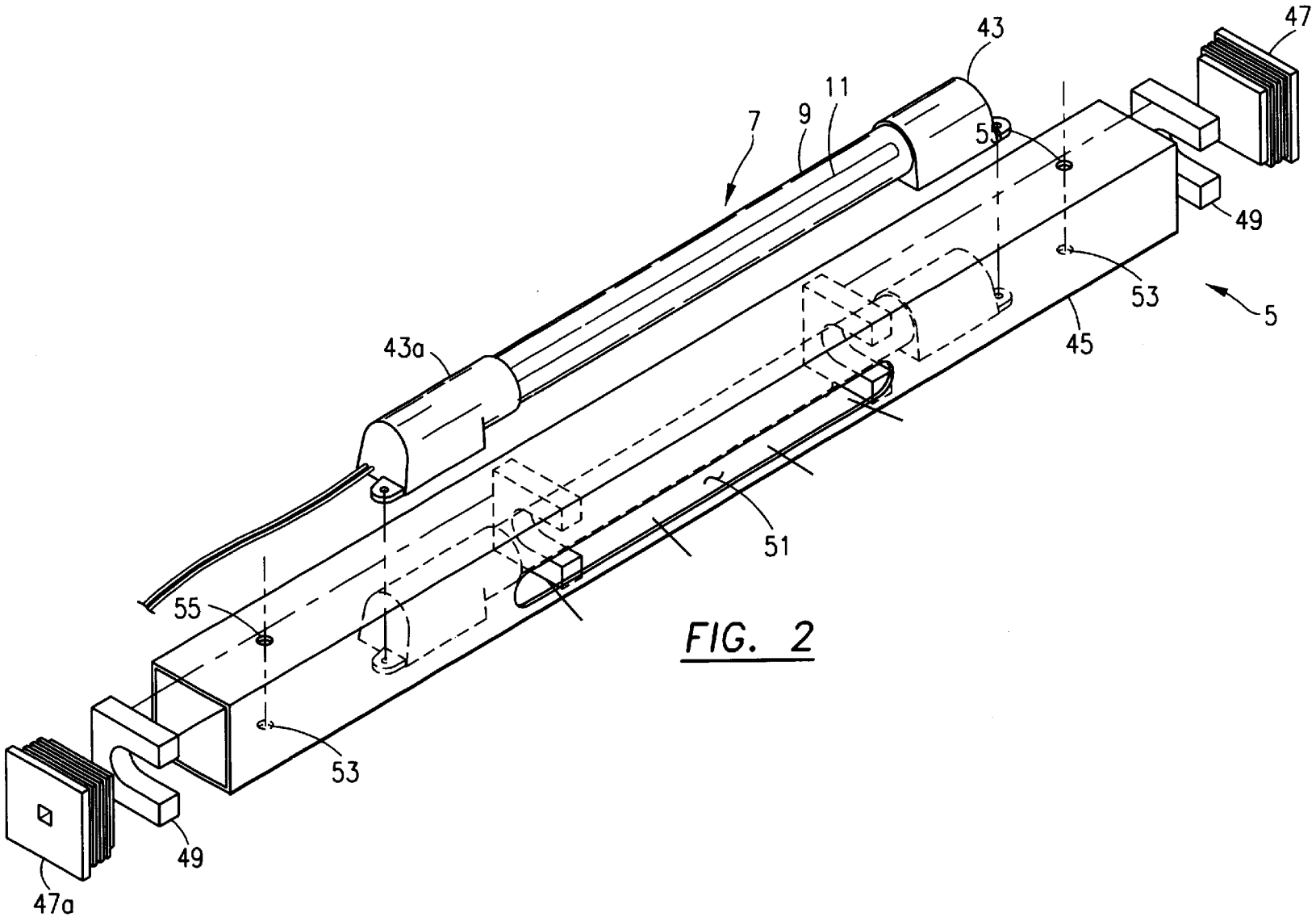
FIG. 2 is a perspective view partially exploded and in phantom of a second embodiment of the invention.

Referring to FIG. 2, an alternate embodiment of the invention is shown. The invention includes a lamp enclosure 5, illumination tube 7 and power supply circuitry as described above which is connected to a 110 volt AC power supply (not shown). Illumination tube 7 is formed by a linear elongated cylindrical discharge tube 11 contained within a hollow transparent cylindrical tube cover 9 closed and sealed at both ends by the attachment of end caps 43 and 43*a*. Tube cover 9 can be made of transparent plastic, polycarbonate or any other suitable transparent material. End caps 43 and 43*a* receive discharge tube 11 and tube cover 9 holding discharge tube 9 so that it is centered within tube cover 9. End caps 43 and 43*a* are constructed of an opaque material such as plastic and seal discharge tube 11 within tube cover 9 by attachment using adhesive. End cap 43*a* contains and seals the second high voltage transformer. The second transformer receives 12 volt DC from rectifier 12 and converts it to 7000–9000 volt DC current sufficient to energize illumination tube 7. End cap 43*a* allows the second high voltage transformer to be electrically connected with the discharge tube 6 and with the first transformer/rectifier by suitable electrically wiring.

Lamp enclosure 5 is formed by a hollow elongated rectangular main housing 45 and end plugs 47 and 47*a*. Illumination tube 7 is enclosed and contained within main housing 45. Main housing 45 is constructed of an opaque material such as aluminum or other material with similar strength properties and is open at each end. End plugs 47 and 47*a* are constructed of an opaque material such as plastic or rubber. End plugs 47 and 47*a* are fit firmly within and close/seal each open end of main housing 45. End plug 47*a* allows wiring to pass from the rectifier through to the second transformer 8. The illumination tube 7 is mounted within enclosure 5. High density foam 49 which is contoured to receive illumination tube 7 firmly secures illumination tube 7 within main housing 45. Main housing 45 has a light aperture 51 corresponding to the location of the discharge tube 11 enclosed within which allows light emitted from discharge tube 11 to pass through and illuminate the desired area. Main housing 45 attaches to a solid fixture such as a wall using screw or bolt fasteners with holes 53 and 55.

In operation light between the 680–780 nm illuminates a dock (FIG. 1) or a stairway (FIG. 2) for humans without disturbing turtles.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. The method of illuminating outdoor areas for human safety and to protect turtle nesting comprising the steps of:

a) installing an outdoor light source in outdoor areas used by humans having a wavelength between 680 nm and 780 nm that is least harmful to turtle nesting; and b) illuminating said light source during darkness for human safety without disturbing turtle nesting.

2. The method of claim 1 further including:

directing the light source in a small area by a fixture with an aperture.

3. An outdoor light source observable to humans for mounting where sea turtle nesting occurs comprising:

an illumination gas discharge tube emitting light of wavelengths between 680–780 nm which are not observable to sea turtles when energized;

a transparent protective tube cover which encloses said illumination gas discharge tube;

power supply circuitry having a first and second transformer and a bridge rectifier, the first transformer and bridge rectifier electrically connected for reducing 110 volts AC to 12 volt DC, the second transformer stepping up voltage to 7000–9000 volts DC for energizing said illumination tube; and a lamp enclosure fixture for enclosing, said illumination gas discharge tube and said second transformer mounted therein, said fixture having an aperture directing light towards a small intended area to be lighted below said lamp, while minimizing direct and indirect lighting of the nearby horizon as well as preventing direct visibility of said illumination tube from the nearby horizon.

4. The outdoor light source of claim 3 wherein said illumination gas discharge tube and said cover are concentric and are arranged in a circle;

said fixture having a support base, a cylindrical shade, and a hollow vertical support, said cylindrical shade having a closed top and an open bottom, said illumination tube enclosed within said shade being and attached to the inside top of said shade by brackets, said vertical support being smaller in diameter than said illumination tube and attached to said base, said vertical support enclosing and housing said second transformer, said shade allowing the passage of light emitted from said illumination tube through the open end of said shade towards the intended area in a predetermined area pattern.

5. The illumination device of claim 3 wherein said discharge lamp and said tube holder are elongated and cylindrical;

said tube holder having a tube cover and end caps, said tube cover being cylindrical and transparent extending the complete axial length of said discharge lamp enabling light to pass outwardly through to provide illumination unobstructed from end to end, said end caps sealing each end of said tube cover while holding said discharge lamp within the center of said tube cover, one end cap housing and enclosing said second transformer device;

said fixture having an elongated rectangular main housing and end plugs, said main housing constructed of an opaque material adapted to enclose and house said illumination tube, said end plugs adapted to allow wiring to pass through to said illumination tube, said main housing further adapted with an aperture corresponding with the location of the illumination tube contained within adapted to direct light emitted from said illumination tube towards the intended area.

* * * * *